US006238271B1

(12) United States Patent
Cesna

(10) Patent No.: US 6,238,271 B1
(45) Date of Patent: May 29, 2001

(54) METHODS AND APPARATUS FOR IMPROVED POLISHING OF WORKPIECES

(75) Inventor: Joseph V. Cesna, Nlles, IL (US)

(73) Assignee: Speed Fam-IPEC Corp., Chandler, AZ (US)

( * ) Notice: Subject to any disclaimer, the term of this patent is extended or adjusted under 35 U.S.C. 154(b) by 0 days.

(21) Appl. No.: 09/302,970

(22) Filed: Apr. 30, 1999

(51) Int. Cl.[7] ..... B24B 1/00

(52) U.S. Cl. ..... 451/41; 451/526; 451/527; 451/529

(58) Field of Search ..... 451/28, 41, 59, 451/63, 285, 286, 287, 259, 268, 269, 526, 527, 528, 529, 530, 539, 548, 550; 428/167

(56) References Cited

U.S. PATENT DOCUMENTS

| | | | | |
|---|---|---|---|---|
| 5,131,190 | | 7/1992 | Gougouyan . | |
| 5,177,908 | | 1/1993 | Tuttle . | |
| 5,216,843 | | 6/1993 | Brievogel et al. . | |
| 5,297,364 | | 3/1994 | Tuttle . | |
| 5,628,862 | | 5/1997 | Yu et al. . | |
| 5,645,469 | | 7/1997 | Burke et al. . | |
| 5,690,540 | | 11/1997 | Elliott et al. . | |
| 5,882,251 | * | 3/1999 | Berman et al. | 451/285 |
| 5,921,855 | * | 7/1999 | Osterheld et al. | 451/527 |
| 5,984,769 | * | 11/1999 | Bennett et al. | 451/527 |

FOREIGN PATENT DOCUMENTS

WO 98/12020 3/1998 (WO) ..... B24B/37/04

OTHER PUBLICATIONS

"Particle Dynamic in Grooves" by D. Bramono et al., Feb. 11–12, 1999 CMP–MIC Conference, 1999 IMIC–400P/99/0159, pp. 159–162.

* cited by examiner

*Primary Examiner*—Derris H. Banks
(74) *Attorney, Agent, or Firm*—Snell & Wilmer, L.L.P.

(57) ABSTRACT

An apparatus for the improved polishing or planarizing of workpiece surfaces which includes polishing pad with a plurality of self-cleaning and anti-tracking grooves along the surface of the pad. The self-cleaning grooves uniformly guide slurry and polishing debris radially outward across the surface of the pad while the anti-tracking capability acts to passively reduce the creation of localized wear zones into the polishing surface. Preferably, the grooves define a concentric pattern upon the surface of the pad and have a cross-section that is cut into a compound shape that has both a vertical and sloped surfaces. Other embodiments may include grooves with sloped parallel surfaces formed into spiral or radial patterns.

24 Claims, 4 Drawing Sheets

METHODS AND APPARATUS FOR IMPROVED POLISHING OF WORKPIECES

BACKGROUND OF THE INVENTION

1. Field of the Invention

The present invention relates generally to the field of semiconductor wafer processing and, more particularly, to the polishing of semiconductor wafers utilizing chemical mechanical polishing technologies using polishing pads.

2. Background of the Related Art

The advances in integrated circuit device technology have necessitated the advancement of chemical mechanical polishing (CMP) technology to provide better and more consistent surface planarization processes. The manufacture of these devices (i.e. complementary metal oxide semiconductors (CMOS), very large scale integration (VLSI), ultra-large scale integration (ULSI), microprocessors, semiconductor memory, and related technologies) on prepared substrates and the preparation of the substrates themselves (prime wafer polishing) require very highly planar and uniform surfaces. To achieve these high levels of planarity and uniformity of surface preparation the processes that produce them must be reliably and consistently performed. Surfaces that are underpolished, overpolished, nonuniform, and/or nonplanar will not produce quality microelectronic devices.

Chemical mechanical polishing processes are used extensively at various stages of integrated circuit processing to planarize surfaces of semiconductor wafers, such as silicon or gallium-arsenide, including prime polishing to prepare the wafers before they enter the device fabrication process. This technology is also employed in polishing optical surfaces, geological samples, metal substrates, as well as other semiconductor-based substrates.

During the device fabrication processes, the wafers may undergo multiple masking, etching, implantation, and dielectric and conductor deposition processes. Many of these processes, especially deposition and etching, may produce a surface that is highly irregular and nonplanar. Due to the high-precision required in the photolithographic steps during the production of these integrated circuits, an extremely flat surface is generally needed on at least one side of the semiconductor wafer to ensure proper accuracy and performance of the microelectronic structures created at the wafer surface. Therefore, between each processing step, it is usually necessary to polish or planarize the surface of the wafer to obtain a substrate surface having a high degree of planarity and uniformity of material removal.

In CMP fabrication techniques, a free abrasive chemical slurry is often used along with a rotating polishing pad, linear polishing belt, or rotating drum to contact the workpiece surface and to polish and planarize that surface. Typical examples of these types of apparatus are described in U.S. Pat. No. 5,329,732, assigned to SpeedFam disclosing a rotating polishing pad polisher; PCT Publication WO 97/20660, assigned to Applied Materials disclosing a linear belt polisher; and U.S. Pat. No. 5,643,056, assigned to Ebara Corporation and Kabushiki Kaisha Toshiba disclosing a rotating drum polisher. The disclosures of the foregoing patents, in relevant part, are incorporated herein, by reference.

In exemplary prior art polishing methods, one side of the wafer is attached to a wafer carrier and the other side of the wafer is pressed against a polishing surface. In general, the polishing surface comprises a polishing pad or belt that can be formed of various commercially available materials such as blown polyurethane. Typically, a water-based colloidal abrasive slurry such as cerium oxide, aluminum oxide, fumed/precipitated silica or other particulate abrasives is deposited upon the polishing surface. During the polishing or planarization process, the workpiece (e.g., silicon wafer) is typically pressed against the moving (e.g., rotating or linearly translating) polishing surface. In addition, to improve the polishing effectiveness, the wafer may also be rotated about its vertical axis and/or oscillated over the inner and outer radial surface of the polishing surface.

When pressure is applied between the polishing pad and the workpiece being polished, mechanical stresses and the abrasive particles within the slurry create mechanical strain on the chemical bonds that form the surface being polished. These stresses render the chemical bonds more susceptible to chemical attack or corrosion (e.g., stress corrosion). Consequently, microscopic regions are removed from the surface being polished which results in enhancing the planarity of the polished surface.

Presently known polishing techniques are unsatisfactory in several regards. For example, when the slurry is deposited at the polishing pad, the slurry often does not cover the entire surface of the polishing pad, leaving dry spots. In addition, the slurry may not be evenly distributed across the entire surface of the polishing pad leaving a distribution of slurry that is excessive or inadequate in different areas. This uneven distribution negatively effects the material removal rate and wafer uniformity and planarity, thereby resulting in finished workpieces having poor quality. Various modifications to the pad surface to aid in slurry distribution are known in the prior art. These modifications include spiral grooves, v-shaped and square-bottomed grooves, and cross-hatched patterns. Although these modifications may assist in the transfer of slurry across the polishing surface, they cause or fail to eliminate other difficulties.

One of these unresolved difficulties is the movement of debris into and out of the grooves in the pad and across the polishing surface. As polishing continues, debris is created either from the removed wafer film materials or from the pad itself (due to conditioning or direct wear during polishing). The debris acts to clog presently known grooved, channeled, and perforated structures in the pad. The slurry is typically in a hydrated state and, if allowed to stagnate in any grooves, channels, or perforations of the polishing surfaces the slurry will begin to dry, aggregate, and pack these structures. If any of this hardened slurry is allowed to reach the workpiece surfaces during polishing, severe scratching of the workpiece can result. This problem is particularly significant in square shaped grooves and perforated structures that are shown in cross-section in FIG. 1. As can be seen in FIG. 1 it is easy for the slurry and debris 130 to enter the hollow features 110 in the polishing surface but difficult for the slurry and debris to exit. This transport limitation results in excessive stagnation of the entrapped material 130 which in turn, leads to aggregation and ultimately to scratching of the workpiece surface. V-shaped channels or grooves, shown in cross-section in FIG. 2, seek to alleviate this and other problems, but do so inadequately and cause further difficulties due to their ability to bi-directionally 230 "pump" the used slurry and debris.

In general, symmetric grooves allow either irregular pumping, no pumping, or bi-directional pumping and all of these effects are undesired. Centripetal acceleration generated by the rotation of the platen and motion of the wafer over the pad provides for the "pumping" of the slurry and debris across the polishing surface. In a square shaped symmetric groove, the vertical walls of the grooves do not allow for transport of the slurry and debris across the polishing surface. Specifically, it is difficult for the slurry and debris to "climb" the vertical wall under the centripetal force provided by the rotation. Furthermore, the motion of the wafer across the grooves in the polishing surface effectively seals the grooves allowing no pumping action or, in the best case scenario, irregular pumping. Therefor, slurry and debris are not evenly transported across the polishing surface. V-shaped grooves with sloped sides allow improved transport under the effects of the centripetal force, however; they permit the motion of the wafer to pump slurry bi-directionally. Furthermore, this bi-directional pumping of the slurry results in the new slurry becoming contaminated with the old slurry and debris.

Any sharp exposed edges or points (asperities) 120, FIG. 1, in the polishing surface that contact the wafer will result in dishing or other process irregularities. These features are omnipresent in square-grooved polishing surfaces. Land areas 140, FIG. 1, or 240, FIG. 2, are the upper surfaces of a grooved, channeled, or perforated surface that contact the workpiece. Land areas that change in shape or area density during the lifetime of the pad or processing cycle of the workpiece also should be avoided. These changes in the land density alter the distribution of slurry and polishing pressure across the surface of the workpiece while the workpiece is in contact with the pad and lead to non-uniform and non-planar polishing and disruption of the long term stability of the batch processing of workpieces. As a V-grooved pad wears, the width of the "V" varies and this trend promotes, rather than corrects, the problems associated with changing land area.

An additional cause of poor polishing performance is the uneven or irregular wear of the polishing surface itself. The polishing process removes material simultaneously from both the workpiece and the polishing pad. If the removal of material from the pad surface is irregular, tracking and formation of a non-planar polishing surface occurs. Tracking is the formation of a nonplanar profile of the polishing surface that is lower (more worn) in the center of the wafer polishing region and higher (less worn) at the periphery of the wafer polishing region. Consequently, the polishing effects that are brought about by aspects of the polishing surface can be non-uniform across the surface of the workpiece, resulting in a non-uniform workpiece surface. Typical prior art polishing pad surface structure designs (e.g., U.S. Pat. No. 5,177,908, assigned to Micron Technology, Inc.) attempt to provide constant surface contact rates between the workpiece and the polishing surface but still allow tracking to occur. Tracking may be partially corrected by repeated excessive conditioning of the pad with abrasives, however; this process significantly reduces the lifetime of the polishing pad thereby increasing usage costs.

For the above detailed reasons and others, apparatus and methods are thus needed which will permit a higher degree of planarization and uniformity over the entire surface of the workpiece. These parameters can be affected by methods and apparatus that uniformly and evenly distribute the slurry across a polishing surface and which provide self-cleaning and anti-tracking of the polishing surface and workpiece.

SUMMARY OF THE INVENTION

The present invention provides a method and apparatus for controlling the self-cleaning and anti-tracking functions of a polishing surface in order to overcome many of the shortcomings of the prior art, such as resulting uneven and non-uniform workpiece surfaces.

In accordance with one aspect of the present invention, the polishing pad comprises a plurality of grooves on the surface of the pad for providing improved uniform guiding and unidirectional pumping of a slurry and polishing debris radially outward across the entire surface of the pad.

In accordance with a further aspect of the invention, the grooves are cut into the polishing surface with a cross-section that has a compound shape that has both vertical and sloped surfaces. Other embodiments may include grooves with sloped surfaces that are in parallel alignment with one another.

In accordance with a further aspect of the present invention, the self-cleaning and anti-tracking functions of the surface may be optimally configured as a function of one or more of: the number, size, and spacing of slurry grooves; the texture of the surface; the cross-sectional contour of the grooves; the groove pattern; and the rotational or translational speed of the polishing surface.

BRIEF DESCRIPTION OF THE DRAWINGS

Specific details of the present invention will be better elucidated via inspection of the following description and figures of the prior art and present invention.

DETAILED DESCRIPTION OF THE PREFERRED EMBODIMENTS

The subject invention relates to an improved polishing surface for use in processing workpiece surfaces and an apparatus including the same. Although the workpiece may comprise virtually any device requiring a controlled finish, the present invention is conveniently described with reference to semiconductor wafers that require a controlled, planar, and uniform surface finish. It will be understood by those skilled in the art, however, that the invention is not limited to any particular type of workpiece, polishing surface (e.g., pad, belt, lapping plate, etc.) or any particular type of workpiece surface finish.

Since the methods of operation and apparatus for performing polishing and lapping functions are well known in the art, they are not described in detail here. Only those portions of an exemplary apparatus that relate directly to the use of the present invention are described.

Figure 1:
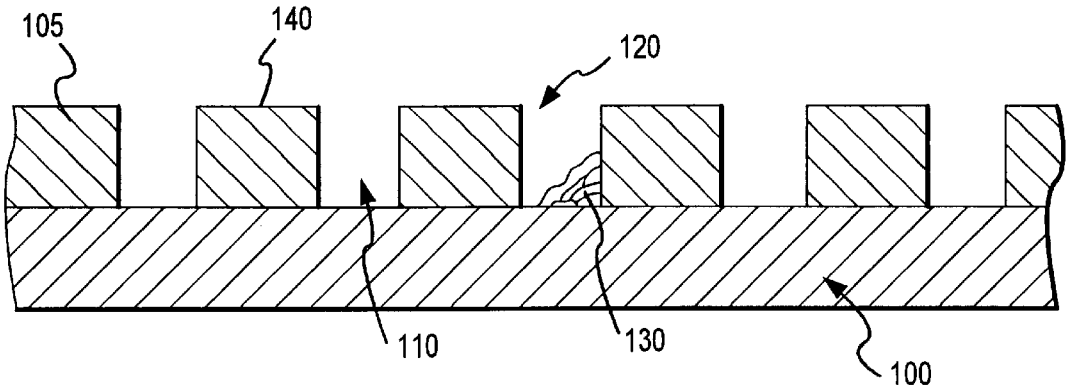
FIG. 1 is a cross-sectional view of a square-grooved prior art polishing pad.
Figure 2:
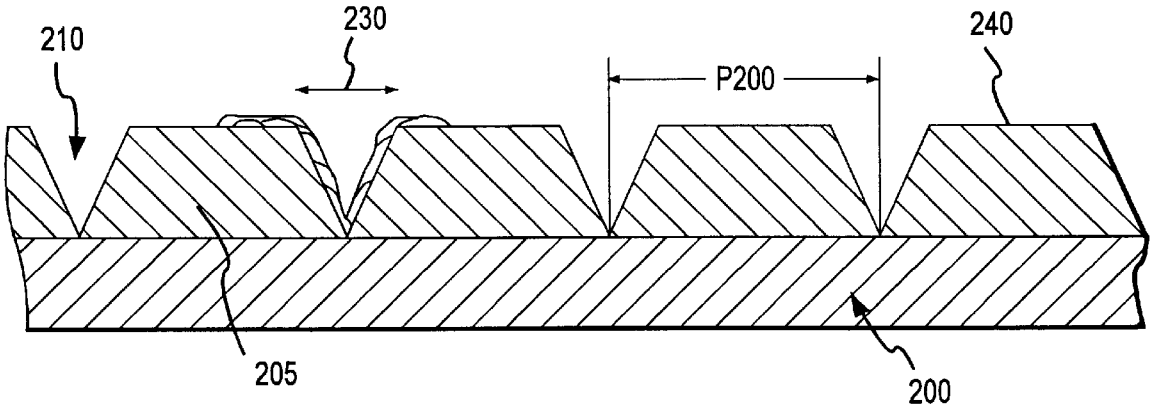
FIG. 2 is a cross-sectional view of a v-grooved prior art polishing pad.
Figure 3A:
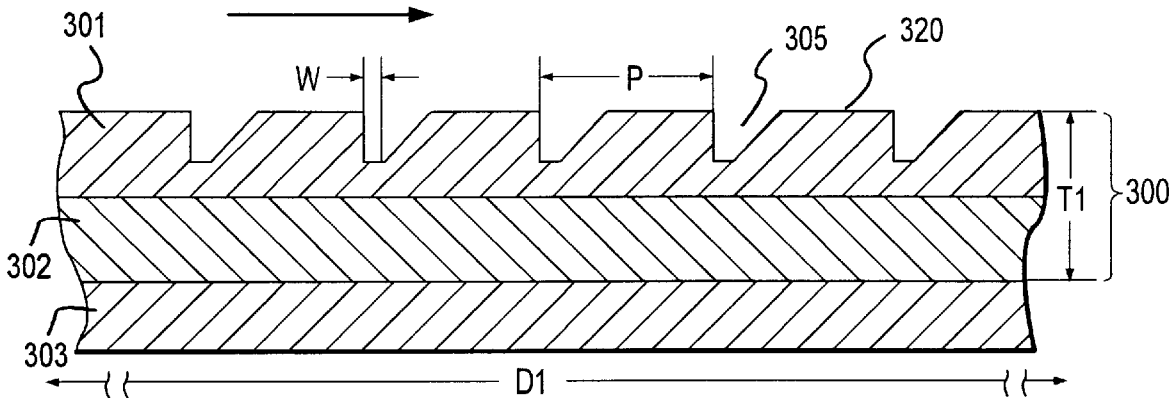
FIGS. 3A, 3B and 3C are cross-sectional views of a polishing pad in accordance with the present invention.
Figure 3B:
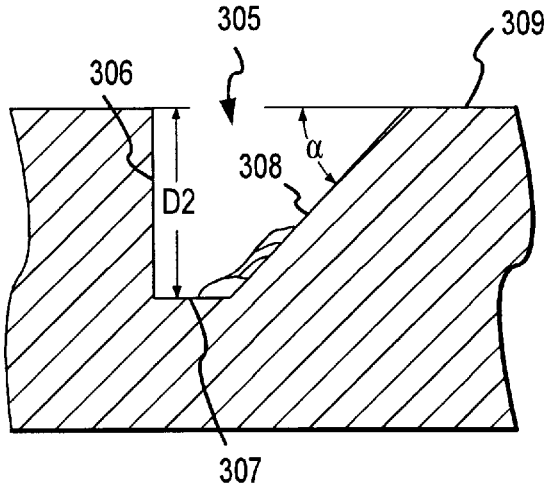

Referring now to FIGS. 3A and 3B, polishing pad 300 will be described in more detail in accordance with the present invention. FIG. 3A depicts a cross-sectional view of pad 300. Pad 300 preferably comprises a substantially flat surface 320 characterized by relatively few surface irregularities. Pad 300 may be comprised of a variety of materials such as polyurethane, felt, fabric, and the like. In a preferred embodiment, the polishing pad has a diameter D1 of 25 to 40 inches (most preferably, 32 inches) and a thickness Ti of 0.04 to 0.15 inches (most preferably, 0.10 inches). The pad 300 may also be comprised of multiple layers (e.g., top layer 301 and bottom layer 302) that are often formed of different materials. In a preferred embodiment of a two-layer pad, the top layer 301 is a material of type IC-1000 or similar material as manufactured by Rodel of Scottsdale, Ariz. The bottom layer 302, also manufactured by Rodel, is a material of type Suba IV or similar type material. The pad 300 is mounted for support and rotational motion onto a polishing platen 303.

With continued reference to FIG. 3A and 3B, pad 300 further comprises a plurality of grooves 305 along the surface of pad 300. Grooves 305 are appropriately configured for self-cleaning and anti-tracking functions, as will be elucidated below, and furthermore to uniformly and evenly distribute the slurry across pad 300 by helping unidirectionally guide or impel the slurry and polishing residues into and out of the grooves, respectively. Grooves 305, coupled with the angular rotation of pad 300 about its vertical axis and pumping action of the wafer in contact with the pad, facilitate the self-cleaning and anti-tracking functions as well as a more uniform and even distribution of the slurry across the entire surface of pad 300. Consequently, under the present invention, the surfaces of the workpieces exhibit a higher degree of surface planarity and uniformity than achievable with prior art pads.

With further reference to FIGS. 3A and 3B, and in accordance with a particularly preferred embodiment, there are approximately 50 to 300 grooves (preferably about 200 grooves), suitably spaced equidistantly on pad 300. Furthermore, each groove 305 has a depth D2 of 0.005 to 0.01 inches (preferably, 0.020 inches), a width W of 0.01 to 0.1 inches (preferably, 0.030 inches), a width P of 0.01 to 0.1 inches (preferably, 0.05 to 0.10 inches) and a cut in such a manner as to facilitate self-cleaning, anti-tracking, and improved slurry flow. In a preferred embodiment, each groove 305 comprises two walls 306 and 308, and a bottom surface 307. Preferably, wall 306 is vertical (i.e. perpendicular to the surface 320) and nearer to the center of the platen than wall 308. Furthermore, wall 308 is inclined at an angle $\alpha$ with respect to a normal to the surface 320. The angle $\alpha$ is preferably approximately 15 degrees; although any angle from 5 to about 60 degrees may perform adequately depending on polishing conditions and the material being polished.

The compound shape of the groove as defined above, coupled with the centripetal acceleration generated by the rotation of the platen, facilitates the self-cleaning of the grooves and moves slurry across the pad surface. The inclination of wall 308 thus allows the slurry to move easily up the wall and across the pad while wall 306 restricts slurry motion in the opposite direction. Motion of the wafer over the pad also acts to pump slurry into and out of the grooves and by having a groove with combined sloped and vertical walls, the pumping occurs primarily in only one direction.

Figure 3C:
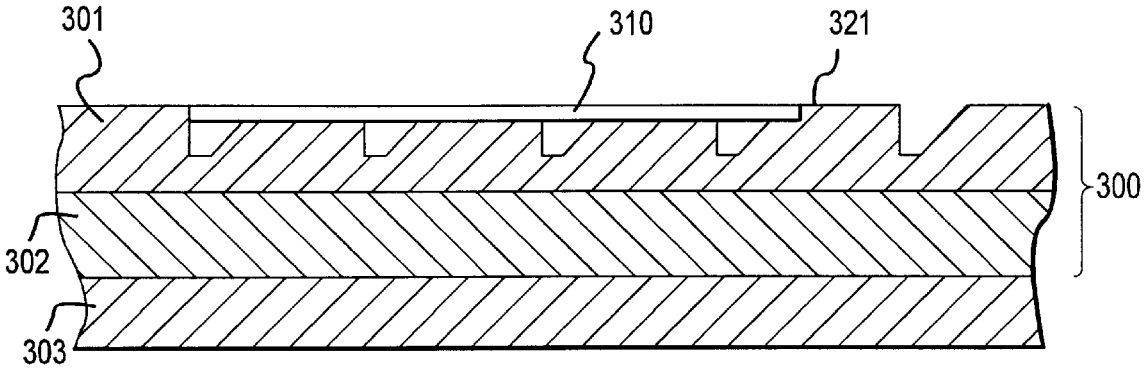

FIG. 3C shows another preferred embodiment of a polishing pad in accordance with the present invention. The polishing pad in FIG. 3C is like that shown in FIG. 3A with the exception that the polishing surface of the polishing pad 300 in FIG. 3C has a contoured surface 321 which is shaped to the contour of the surface of a workpiece 310 that is being polished. In addition, contoured surface 321 may comprise any type of variation on the surface of the polishing pad 300 which is not substantially planar even when a workpiece 310 is not resting on the surface of the polishing pad 300.

Figure 4:
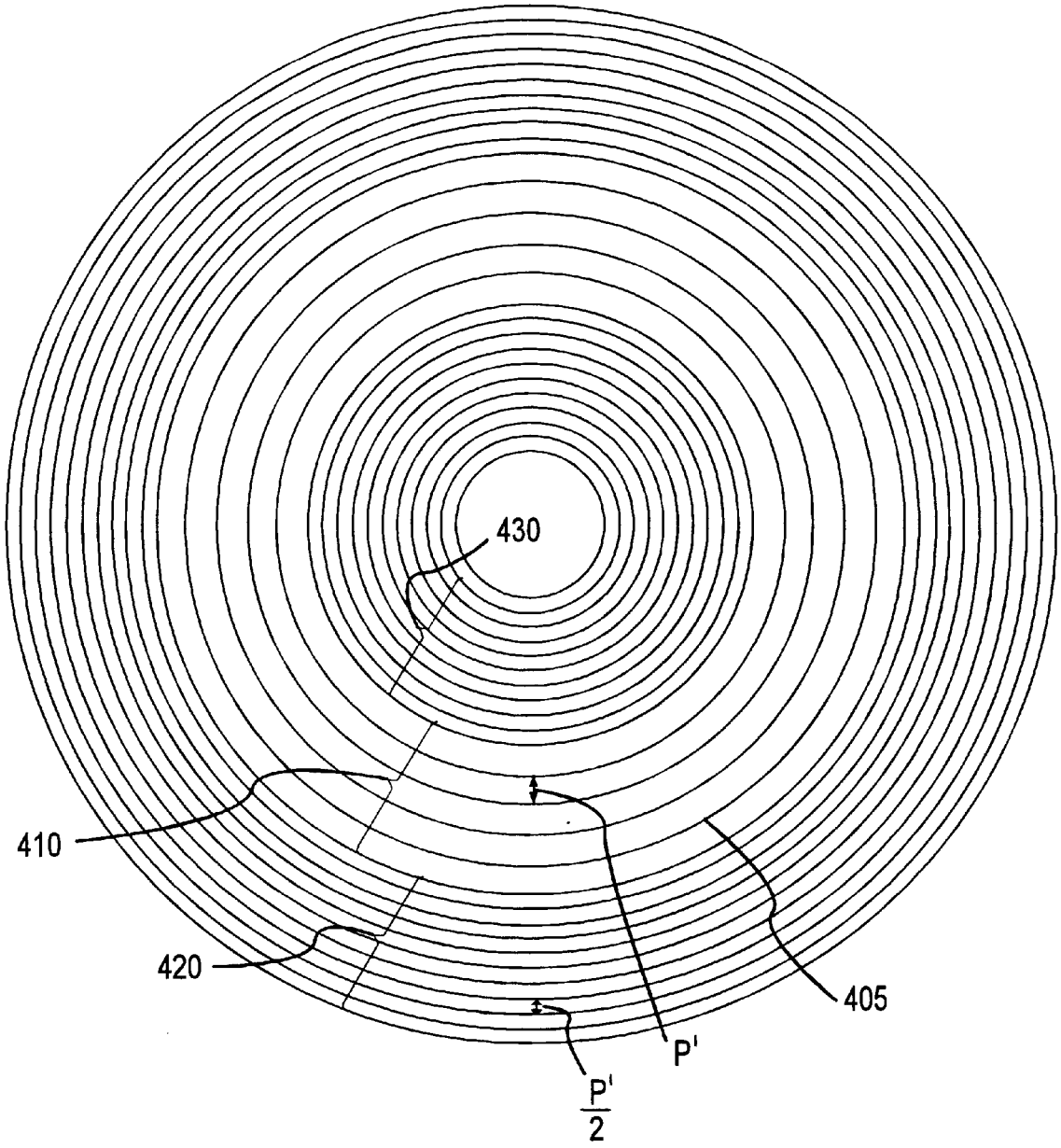
FIG. 4 is a plan view of a polishing pad in accordance with the present invention.

In a preferred embodiment, FIG. 4, the above-described self-cleaning grooves are positioned on a polishing pad 400 in an anti-tracking configuration. As detailed above, tracking is the formation of a nonplanar profile of the polishing surface that is lower (more worn) in the center of the wafer polishing region and higher (less worn) at the periphery of the wafer polishing region. Grooves 405 are shown to have a graded anti-tracking pattern that has higher groove densities both nearer the center and the periphery of the polishing pad 400. By this pattern, the land (area of the polishing surface without grooves) density is increased in the zone of the polishing pad 400 that is used for polishing the workpiece. In a preferred embodiment, the graded pattern has a width that is larger than the width of the workpiece which is typically 6, 8, or 12 inches. Furthermore, the pattern is evenly graded from a narrow pitch nearer the center 430 and periphery 420 of the polishing pad 400 to a wider pitch in the center of the polishing zone 410.

Preferredly, the pitch P varies from a value of P' near the center of the tracking region 410 to a value of ½ P' near the periphery of the tracking region at the center region 430 and peripheral region 420 of the polishing pad surface. The variation in pitch may be linear from region 410 to regions 420 and 430 or may be non-linear to account for the geometry of the workpiece that is causing the tracking wear (e.g., a trigonometric functional form for a circular workpiece).

Additionally, the pitch may be further configured to allow for constant surface area rate contact between the wafer and the moving polishing pad surface. In such an embodiment, the variation in pitch would not be symmetrical about the center of the track region 410 but would have a larger pitch in region 420 than region 430.

The addition of more land area (wider pitch) near the center of the polishing zone provides for a lower total force per unit area on the lands resulting in a lower removal rate for the pad material during polishing. The narrower pitch near the periphery of the polishing zone decreases the land area and increases the force per unit area of land during polishing. Furthermore, the increased force enhances the removal rate of the pad material in those areas of the polishing zone. Therefore, the combination of the differing pad material removal rates at the peripheries and in the center of the polishing zone results in a maintained uniform polishing surface that is anti-tracking. Thus, in accordance with the present invention, a method and apparatus for providing self-cleaning and anti-tracking functions in a polishing pad, as well as uniformly and evenly distributing a slurry about a polishing pad and providing a higher degree of planarization of a workpiece surface is provided.

The grooves that are an object of the present invention may be formed into the polishing surface ex situ (e.g., during the manufacturing process) by specialized cutting and turning machines that are currently used to create v-shaped and square-shaped grooves in the pads. However, it may be advantageous to form the grooves in situ (e.g., during the use of the polishing pad) to allow for direct customization by the end-users. Furthermore, a specifically designed cutting tool may be used to re-fit or re-form the grooves into the polishing surface as the polishing surface wears and is periodically reconditioned.

Although the present invention is set forth herein in the context of the appended drawing figures, it should be appreciated that the invention is not limited to the specific forms shown. Various other modifications, variations, and enhancements in the design and arrangement of the polishing apparatus as set forth herein may be made without departing from the spirit and scope of the present invention as set forth in the appended claims. For example, while the exemplary invention embodies a device for polishing semiconductor wafers, it should be understood that the invention is not limited to any particular type of workpiece and may be used for such things as polishing or lapping of device wafers, hard disks, and glass polishing, at both low and high material removal rates. Also, while the grooves in the polishing pad are shown in the figures as having a specific shape, those skilled in the art will appreciate that other groove configurations are also possible for facilitating the anti-tracking and self-cleaning of the polishing pad.

What is claimed is:

1. A polishing surface for use with a slurry in processing a workpiece surface, wherein said polishing surface includes:

a plurality of grooves wherein each of said grooves includes a cross-section having both a vertical wall and a sloped wall, and wherein said vertical wall and said sloped wall each juxtaposes the polishing surface.

2. The polishing surface of claim 1 wherein said grooves are spaced apart from one another to reduce tracking.

3. The polishing surface of claim 1 wherein said plurality of grooves extend concentrically about said polishing surface.

4. The polishing surface of claim 1 wherein said surface is substantially planar.

5. The polishing surface of claim 1 wherein said surface is contoured.

6. The polishing surface of claim 1 wherein each of said plurality of grooves comprises a recess in the polishing surface having a depth and a width, said depth being in a range of 0.005 to 0.01 inches and said width being in a range of 0.01 to 0.1 inches.

7. The polishing surface of claim 1 wherein said sloped wall is inclined at an angle in a range of 10 to 50 degrees from normal to said polishing surface.

8. The polishing surface of claim 1 wherein said polishing surface comprises a polishing pad rotating about a vertical axis normal to said polishing surface.

9. The polishing surface of claim 1 wherein said polishing surface comprises a translating polishing belt.

10. The polishing surface of claim 1 wherein said polishing surface comprises a fixed, non-rotating polishing pad.

11. The polishing surface of claim 1 wherein said polishing surface has an inner diameter, outer diameter, and a thickness, said outer diameter being in a range of 25 to 40 inches, said inner diameter being in a range of 0 to 15 inches, and said thickness being in a range of 0.04 to 0.25 inches.

12. The polishing surface of claim 1 wherein said polishing surface is comprised of at least one of a polyurethane, a polymer, a felt, a fabric, and a metal.

13. The polishing surface of claim 1 wherein said plurality of grooves includes a number of grooves in a range of 50 to 300 grooves.

14. A method for planarizing a surface of a workpiece comprising the steps of:

forming a plurality of grooves in a polishing surface wherein said grooves include a cross-section comprising both a vertical wall and a sloped wall, wherein said vertical wall and said sloped wall each juxtaposes the polishing surface, and wherein said grooves are spaced apart from one another to reduce tracking;

moving at least one of said polishing surface and said workpiece to produce relative motion;

depositing slurry on said polishing surface; and pressing the surface of said workpiece against said polishing surface in the presence of said slurry.

15. The method of claim 14 wherein said step of forming a plurality of grooves comprises positioning said plurality of grooves concentrically about said polishing surface.

16. The method of claim 14 wherein said step of forming a plurality of grooves in a polishing surface comprises the step of forming a plurality of grooves in a substantially planar polishing surface.

17. The method of claim 14 wherein said step of forming a plurality of grooves in a polishing surface comprises the step of forming a plurality of grooves in a contoured polishing surface.

18. The method of claim 14 wherein said step of forming a plurality of grooves comprises the step of forming a plurality of recesses in the polishing surface having a depth and a width, said depth being in a range of 0.005 to 0.01 inches and said width being in a range of 0.01 to 0.1 inches.

19. The method of claim 14 wherein said step of forming a plurality of grooves comprises the step of forming grooves having sloped walls inclined at an angle in a range of 10 to 50 degrees from normal to said polishing surface.

20. The method of claim 14 wherein said step of moving at least one of said polishing surface and said workpiece comprises the step of rotating said polishing surface about a vertical axis normal to said polishing surface.

21. The method of claim 14 wherein said step of forming a plurality of grooves comprises the step of forming a plurality of grooves in a translating polishing belt.

22. The method of claim 14 wherein said step of forming a plurality of grooves in a polishing surface comprises the step of forming grooves in a polishing surface having an inner diameter, outer diameter, and a thickness, said outer diameter being in a range of 25 to 40 inches, said inner diameter being in a range of 0 to 15 inches, and said thickness being in a range of 0.04 to 0.25 inches.

23. The method of claim 14 wherein said step of forming a plurality of grooves in a polishing surface comprises the step of forming a plurality of grooves in a polishing surface comprised of at least one of a polyurethane, a polymer, a felt, a fabric, and a metal.

24. The method of claim 14 wherein said step of forming a plurality of grooves includes forming a number of grooves in a range of 50 to 300 grooves.

* * * * *